United States Patent [19]

Shimizu et al.

[11] Patent Number: 4,525,092

[45] Date of Patent: Jun. 25, 1985

[54] TUBULAR WRITING TIP HAVING AN OUTER REDUCED DIAMETER PORTION

[75] Inventors: Takahiko Shimizu; Hishao Fukui, both of Tokyo; Tadashi Kohno, Ishioka, all of Japan

[73] Assignee: Pentel Kabushiki Kaisha, Tokyo, Japan

[21] Appl. No.: 566,970

[22] PCT Filed: Mar. 26, 1982

[86] PCT No.: PCT/JP81/00066

§ 371 Date: Mar. 19, 1982

§ 102(e) Date: Mar. 19, 1982

[87] PCT Pub. No.: WO82/03360

PCT Pub. Date: Oct. 14, 1982

Related U.S. Application Data

[63] Continuation of Ser. No. 361,929, Mar. 19, 1982, abandoned.

[30] Foreign Application Priority Data

Sep. 29, 1979 [JP] Japan ..... 54-135438[U]

[51] Int. Cl.[3] ..... B43K 1/06; B43K 15/00

[52] U.S. Cl. ..... 401/265; 401/251; 401/258; 401/259

[58] Field of Search ..... 401/209, 216, 258, 259, 401/260, 251, 261, 265

[56] References Cited

U.S. PATENT DOCUMENTS

| | | | |
|---|---|---|---|
| 3,388,455 | 6/1968 | Wieland . | |
| 3,418,057 | 12/1968 | Shea | 401/209 |
| 4,003,665 | 1/1977 | Dreyer et al. | 401/259 |

FOREIGN PATENT DOCUMENTS

| | | | |
|---|---|---|---|
| 165441 | 9/1955 | Australia | 401/209 |
| 1807848 | 5/1970 | Fed. Rep. of Germany | 401/259 |
| 1906035 | 8/1970 | Fed. Rep. of Germany | 401/259 |
| 2029952 | 12/1971 | Fed. Rep. of Germany | 401/259 |
| 2135780 | 5/1973 | Fed. Rep. of Germany | 401/259 |
| 46-7814 | 12/1971 | Japan . | |
| 47-51414 | 12/1972 | Japan . | |
| 48-40016 | 11/1973 | Japan . | |
| 49-12297 | 3/1974 | Japan . | |
| 004375 | 10/1891 | Switzerland . | |
| 418889 | 2/1967 | Switzerland | 401/209 |
| 475855 | 9/1969 | Switzerland | 401/258 |

*Primary Examiner*—Steven A. Bratlie

*Attorney, Agent, or Firm*—Wenderoth, Lind & Ponack

[57] ABSTRACT

In a nib structure of a writing instrument of the type having a tubular nib fitted to a forward end of a tubular tip of the instrument, the tubular nib is provided with a concentrically reduced diameter portion having an outer surface gently sloped from the ends toward a middle portion of the nib, and a radiused peripheral edge at a rearward end of the nib. The nib structure provides easy and accurate fitting of the nib into the tubular tip.

4 Claims, 7 Drawing Figures

TUBULAR WRITING TIP HAVING AN OUTER REDUCED DIAMETER PORTION

This application is a continuation of now abandoned Ser. No. 361,929, filed Mar. 10, 1982.

TECHNICAL FIELD

This invention relates to a nib structure of a writing instrument having a tubular writing tip wherein a tubular nib made of hard materials having hardwearing properties is mounted to an end of the tubular writing tip.

BACKGROUND ART

A writing instrument having a tubular writing tip connected to an end of a barrel or casing is known, in which ink is fed from an ink reservoir in the barrel to the tubular writing tip. In such a writing instrument, an axially slidable needle or rod is usually provided within the tubular writing tip so as to improve ink feeding.

The writing instrument of the type as described has been used primarily by draftsmen. For drafting, synthetic resin films treated to have a rough surface, such as by sandblasting and chemical mats, have been used, which, however, cause remarkable wearing of the tubular writing tip. In order to minimize such wear, an attempt has been made in which an additional tubular nib made of a hard materials having high wear-resistant properties such as a metal, for example hard stainless steel, chrome-plated brass and the like, precious stones such as ruby and the like, or ceramics, is fitted to an end of the aforementioned tubular writing tip.

The tubular nib is conventionally fitted to the tubular writing tip by employing desired adhesive agents or by press-fitting. During connection by the adhesive agents, the tubular nib is formed with its outer diameter being smaller than an inner diameter of the tubular writing tip so that an annular space is formed between the nib and the tip, and the adhesive agent is supplied into the space. During the press-fitting connection, the tubular nib is formed with its outer diameter being substantially equal to, or slightly larger than, the inner diameter of the tubular tip, and the nib is forcibly inserted into the tip.

In the connection by the adhesive agent, however, it is quite difficult to hold both the annular nib and the annular tip in accurate positions with their axes being aligned with each other since the annular space or gap between the nib and the tip must be formed for inserting therein the adhesive agent. When both the annular nib and the tip are not accurately positioned, thus resulting in non-alignment of their axes, a constant flow of ink will not be expected, and a smooth axial movement of a needle or rod will not be established when the writing instrument is of the type which employs such needle or rod in the tubular tip. In the press-fitting connection, finishing of highest precision is required for the nib and tip since the outer diameter of the nib and the inner diameter of the tip must be controlled with strict dimensional accuracy. To be more specific, an outer diameter of the nib larger than the predetermined dimension will not permit the nib to be inserted into the tip and, on the other hard, a smaller diameter of the nib will apparently fail to firmly connect the two elements together. Besides, even though both the nib and the tip could be formed in a desired dimensional accuracy, problems are still unsolved in that the more accurately are the elements formed, the more accurate must be the press-fitting operation. If a deviation, however small it may be, is produced between the nib-advancing direction and the axial direction of the nib, an excessive thrust is needed to press the nib further into the tip. Such excessive thrust will cause the two elements to be deformed or damaged.

The aforesaid problems encountered during the connection of the elements are due to the fact that both the nib and the tip are extremely small sized, and that even the smallest deviations in the press-fitting direction and in dimensional accuracy result in a larger disadvantageous effect.

SUMMARY OF THE INVENTION

An object of this invention is to provide a nib structure of a writing instrument of the type having a tubular writing tip, which can overcome the aforesaid problems encountered in the conventional operation for press-fitting a tubular nib to the tip, and establish a fine adjustment of deviation of the inserting directions of the nib when such deviations are formed during a press-fitting operation of the nib.

According to this invention, there is provided a nib structure of a writing instrument of the type having a tubular nib fitted to a forward end of a tubular tip of the instrument, characterized in that the tubular nib is provided with a concentrically reduced diameter portion having an outer surface gently sloped toward a middle portion of the nib, and a radiused peripheral edge at a rearward end of the nib.

The inventive nib structure has an advantage that a fine adjustment of the pressing direction of the tubular nib can easily and effectively be established by coaction of a space produced between the outer surface of the reduced diameter portion of the nib and the inner surface of the tubular tip and the radiused edge at the rearward end of the nib, even when the nib has been inaccurately inserted such that the pressing direction of the nib is not aligned with the axial direction of the nib.

In the present invention, the tubular nib can be connected by the press-fitting method. However, if necessary, a desired adhesive agent may be employed in addition to press-fitting.

Preferred embodiments of this invention will be hereinbelow described in detail with reference to the accompanying drawings.

DETAILED DESCRIPTION OF THE INVENTION

Figure 1:
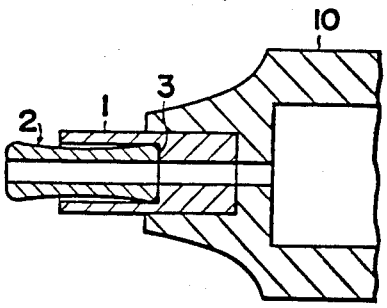
FIG. 1 is a sectional view of an embodiment according to the invention.

With reference to FIG. 1 which shows an embodiment of the invention, a tubular nib 2 is press-fitted to an end of a tubular tip 1. The tubular nib 2 is forcibly inserted into the tubular tip 1 until the rearward end of the nib 2 abuts against a shoulder 3 disposed on the inner surface of the tip 1, with the forward end of the nib 2 projecting slightly beyond the end of the tip 1 to form a writing point. Reference numberal 10 represents a forward end portion of a barrel of the writing instrument, and may be formed integral with the tubular tip 1.

Figure 2:
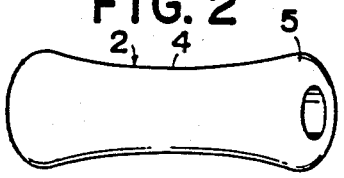
FIG. 2 is an enlarged perspective view of a tubular nib.

As will be understood from FIG. 2, the tubular nib 2 is provided with a concentrically reduced diameter portion 4 having an outer surface gently sloped from the ends toward a middle portion of the nib 2 and a radiused portion 5 at the peripheral edge of a rearward end of the nib 2.

The tubular nib 2 having the reduced diameter portion 4 and radiused edge 5 may be manufactured by, for example, injection-molding a cylindrical nib and then grinding or barrelling it to make the finished nib. It may be possible, of course, to manufacture a tubular nib 2 having the reduced diameter portion 4 and the radiused edge 5 directly by using injection molding. In the present invention, any suitable methods may be selected or combined according to the desired shapes or dimensions of the reduced diameter portion and the radiused edge of the nib 2.

The tubular nib 2 is typically designed to have a length of 3 mm, an outer diameter of 0.6 mm and an inner diameter of 0.3 mm, with a reduction of the outer diameter at the reduced diameter portion being 0.05 mm and a radiused edge being 0.2 mm R. It should be understood, however, that these dimensions are merely an example and this invention is not limited to these dimensions, but an excessive reduction of the outer diameter at the reduced diameter portion results in a decrease in strength of the tubular nib 2 itself.

Figure 3:
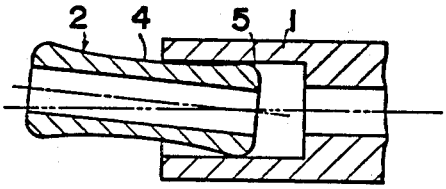
FIG. 3 is a perspective view of the tubular nib, showing the nib in a press-fitting operation.

FIG. 3 illustrates maladjustment wherein the axial direction of the nib 2 is not correctly aligned with the nib-inserting direction, the maladjustment being often seen during the process of press-fitting of the nib 2 into the tubular tip 1. As described above, it is likely that such maladjustment or non-alignment often occurs in the process of press-fitting by using chuck means or by hand (not shown), and such non-alignment becomes a serious obstacle to a further press-fitting. According to the present invention, the press-fitting operation can be continued by correcting the non-alignment which can be accomplished due to the existence of the reduced diameter portion 4 and the radiused edge 5 of the nib 2. In other words, when the tubular nib 2 has been inserted into the tubular tip 1 in the state of non-alignment as illustrated in FIG. 3, the radiused edge 5 is in line contact with an inner surface of the tubular tip 1, and the gentle slope of the reduced outer diameter portion of the nib 2 functions to guide the movement of the nib for correction of the non-alignment along a forward inner edge of the tubular tip 1, so that the tubular nib 2 can be further inserted with the non-alignment being corrected.

Figure 4:
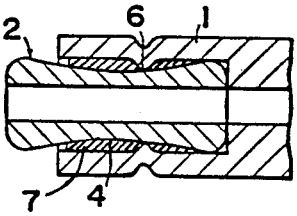
Figure 5:
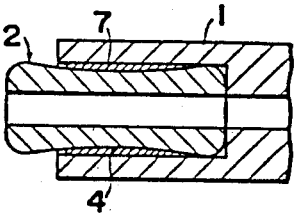

Other embodiments according to the present invention will be described with reference to FIGS. 4 through 7 in which FIGS. 4 and 5 show specific structure for securing the tubular nib 2 relative to, and in alignment with, the tubular tip 1 and for preventing the tubular nib 2 from leaving the tubular tip 1 after the press-fitting of the two elements. In FIG. 4, a protrusion 6 is formed at the inner surface of the tubular tip 1 by pressing a part or the entire annular part of the outer surface of the tubular tip 1, so that the protrusion 6 abuts against a predetermined portion of the reduced diameter portion 4 of the nib. FIG. 5 shows an adhesive agent 7, which is applied on an outer surface of the reduced diameter portion 4 during or after the step of press-fitting of the tubular nib 2 into the tubular tip 1. Hardening of the adhesive agent prevents more effectively slipping-out of the nib 2. In the embodiment of FIG. 5 employing the adhesive agent, ink leakage, which will often occur through a minor gap between the tip 1 and nib 2, can be prevented. Besides, when a crack or split is produced in the tubular nib 2 as a result of the press-fit operation such crack or split can be reinforced by the adhesinve agent. The use of an anaerobic adhesive agent containing tetraethylene glycol dimethacrylate as a main ingredient is preferred, because the anaerobic adhesive agent 7 applied to the area between the nib 2 and the tip 1 will gradually be hardened from the rear portion of the nib, i.e. the air-isolated portion. If desired, the adhesive agent can be applied to the structure of FIG. 4.

Figure 6:
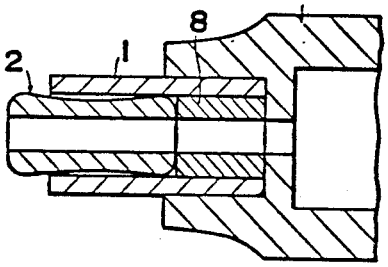
FIGS. 4, 5, 6 and 7 are sectional views of other embodiments according to the invention.

FIG. 6 shows a further modified structure embodying the invention, in which an annular member 8 is inserted into the tubular tip 1 for limiting the insertion of the tubular nib 2. The annular member 8 functions as the shoulder 3 of the structure of FIG. 1 and makes it possible to eliminate difficulties of forming the shoulder 3.

Figure 7:
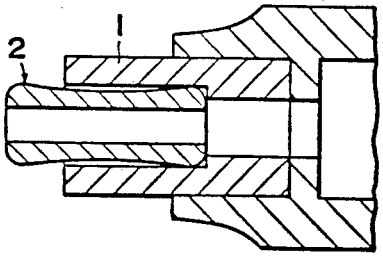

FIG. 7 shows another embodiment of the invention in which tubular nib 2 is designed to have an inner diameter smaller than the inner diameter of the tubular tip 1 so that a greater capillary action is produced within tubular nib 2 than within the tubular tip 1.

As described above, the tubular nib, which is fitted in a tubular tip of the writing instrument, has a gently sloped outer surface to form a reduced diameter portion and a radiused peripheral edge at its rearward end. Accordingly, a deviation of accuracy, which likely occurs during the step of insertion of the nib into the tubular tip, can be corrected, and press-fitting as well as application of an adhesive agent can be effected. Further, axial non-alignment between the nib and the tip can be readily corrected, and constant and continuous flow of ink can be obtained.

The above-illustrated embodiments can be modified within the scope of the basic structure of the invention. For example, all of the illustrated embodiments show the tubular nib 2 of a symmetrical design in which the both rear and fore ends of the nib have radiused edges. Such symmetrical design eliminates the difficulty of finding which end should be inserted into the tubular tip 1. However, the ends of the nib 2 may be formed assymmetrically if the writing properties are not reduced. In order to eliminate a gap or space between an outer surface of the tubular nib 2 and a forward inner end of the tip 1, the tip may be provided with a reduced inner diameter portion at its fore end. Further, the annular member 8 illustrated in FIG. 6 may be deleted so that the tubular nib 2 is inserted into the tip 1 until the rear end of the nib 2 abuts against the wall of the barrel 10.

We claim:

1. In a writing instrument nib structure of the type including a tubular nib press-fitted into a forward end of a tubular tip of the instrument, the improvement of means for enabling press-fitting of said nib into said tip upon misalignment of the longitudinal axis of said nib and the direction of pressing by correcting such misalignment during pressing, said means comprising:

an outer nib surface defining equally configured radiused peripheral edges at opposite longitudinal ends of said nib, said outer nib surface sloping radially inwardly from said radiused peripheral edges toward a middle length portion of said nib, thereby defining a concentrically reduced diameter central portion, such that said nib is longitudinally symmetrical between said opposite ends; and said radiused peripheral edge at a rearward end of said nib contacting an inner surface of said tip, and said sloping surface of said nib and said inner surface of said tip defining therebetween an annular space;

whereby said sloping surface acts to guide pressing movement of said nib while correcting misalignment thereof.

2. The improvement claimed in claim 1, further comprising an adhesive agent provided in said space between said sloping surface of said nib and said inner surface of said tip.

3. The improvement claimed in claim 1, further comprising a protrusion extending from said inner surface of said tip inwardly into said space and abutting said reduced diameter portion of said nib.

4. The improvement claimed in claim 3, further comprising an adhesive agent provided in said space between said sloping surface of said nib and said inner surface of said tip.

* * * * *